US011116264B2

(12) United States Patent
Adams

(10) Patent No.: US 11,116,264 B2
(45) Date of Patent: Sep. 14, 2021

(54) MAGNETIC BUTTON ADAPTER SYSTEM AND METHOD FOR MANUFACTURING

(71) Applicant: Gina Rae Adams, Northville, MI (US)

(72) Inventor: Gina Rae Adams, Northville, MI (US)

( * ) Notice: Subject to any disclaimer, the term of this patent is extended or adjusted under 35 U.S.C. 154(b) by 0 days.

(21) Appl. No.: 16/276,383

(22) Filed: Feb. 14, 2019

(65) Prior Publication Data

US 2019/0246724 A1 Aug. 15, 2019

Related U.S. Application Data

(60) Provisional application No. 62/630,411, filed on Feb. 14, 2018, provisional application No. 62/750,406, filed on Oct. 25, 2018.

(51) Int. Cl.
*A41F 1/00* (2006.01)
*A44B 1/04* (2006.01)

(52) U.S. Cl.
CPC ..... *A41F 1/002* (2013.01); *A44B 1/04* (2013.01)

(58) Field of Classification Search
CPC ..... A41F 1/002; A44B 1/04
See application file for complete search history.

(56) References Cited

U.S. PATENT DOCUMENTS 3,111,737 A 11/1963 Heil
3,372,443 A * 3/1968 Daddona, Jr. ..... A41F 1/002 24/303
4,265,002 A * 5/1981 Hosken ..... A41F 1/002 24/303
4,779,314 A * 10/1988 Aoki ..... A41F 1/002 24/303
5,560,089 A * 10/1996 Morita ..... A41F 1/002 24/303
6,170,131 B1 1/2001 Shin
6,226,842 B1 5/2001 Wong
7,065,841 B2 6/2006 Sjoquist
7,178,207 B2 2/2007 Wong et al.
7,373,696 B2 * 5/2008 Schoening ..... A41D 25/003 24/303
7,992,264 B2 * 8/2011 Abadi ..... A44B 9/08 24/303
8,631,517 B1 1/2014 Blakely
8,667,650 B1 * 3/2014 Duffin ..... A44B 5/007 24/102 SL
9,060,572 B2 6/2015 Hasegawa et al.
9,131,739 B1 * 9/2015 Sjoquist ..... A41F 1/002
9,220,321 B1 * 12/2015 Sun ..... A44B 1/04
9,307,806 B1 * 4/2016 Dorman ..... A44B 17/0005
9,717,293 B2 8/2017 Lim
9,795,191 B2 10/2017 Jacobson
9,974,363 B2 * 5/2018 Bolen ..... A41F 1/00
10,149,517 B2 * 12/2018 McKean ..... A44C 1/00
(Continued)

*Primary Examiner* — David M Upchurch
(74) *Attorney, Agent, or Firm* — Aurora Consulting LLC; Ashley Sloat

(57) ABSTRACT

This invention features magnetic, laundry tolerant, no-sew button adapters that convert traditional shirt buttons into magnetic closures to help people with dexterity limitations. The adapters simply attach to any shirt to help make getting dressed easier and a restore a crucial activity of daily living. Users can simply push the lapels of a shirt together to engage magnetic force, activating the buttons to snap into place. The shirt can be opened easily by pulling the lapels apart to undress.

20 Claims, 14 Drawing Sheets

(56) References Cited

U.S. PATENT DOCUMENTS

| | | | | |
|---|---|---|---|---|
| 2003/0154576 | A1* | 8/2003 | Mirharooni | A44B 5/02 24/41.1 |
| 2009/0056082 | A1* | 3/2009 | Quimod | A44B 1/04 24/113 R |
| 2010/0242230 | A1 | 9/2010 | Cohen | |
| 2010/0263173 | A1* | 10/2010 | Clarke | A41F 1/002 24/303 |
| 2012/0174346 | A1 | 7/2012 | Fildan et al. | |
| 2012/0216374 | A1 | 8/2012 | Manuello | |
| 2014/0130228 | A1* | 5/2014 | Horton | A41F 1/002 2/69 |
| 2016/0360810 | A1* | 12/2016 | Lim | A41F 1/002 |

* cited by examiner

MAGNETIC BUTTON ADAPTER SYSTEM AND METHOD FOR MANUFACTURING

CROSS-REFERENCE TO RELATED APPLICATIONS

This application claims the benefit under 35 U.S.C. 119(e) of U.S. Provisional Applications Nos. 62/630,411 filed on Feb. 14, 2018 and 62/750,406 filed on Oct. 25, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The technology relates to the general field of adaptive technology for lifestyle improvement and has certain specific application to individuals with hand dexterity challenges.

The present invention relates to button covers, methods of manufacturing same, and methods of using same. More particularly, the invention relates to magnetic button covers to aid those with disabilities.

2. Description of the Prior Art

Conventional clothing closures are well known in the art, including one of the most common types of buttons, zippers and other closure types that include hook and loop closures.

However, practitioners of those inventions have become aware of certain problems which are presented by those prior art inventions. One particular problem that has plagued users has been that when an individual loses the ability to operate their fingers to work these closure types. There are complexities which give rise to one's inability to clothe oneself.

Prior art patent US 2014/0130228 describes a shirt or vest with magnets embedded in the plackets of the garment. Button covers are known, which may use magnets to attach ornamentation to a button, as disclosed in U.S. patent application publications US 2015/0250269 and US 2011/0277502, for example magnetic cuff link closures for conventional french cuff shirts are disclosed for example in U.S. Pat. Nos. 2,483,031 and 4,528,726, and in U.S. Patent application publication US 2003/0154576. U.S. Pat. No. 8,667,650 describes magnetic cuff links adapted for use with button cuffs.

Therefore, it would be desirable to the medical and clothing industry if there was provided an easy to close clothing closure system, and methods of making and using.

It would be especially useful to provide a magnetic closure system to allow existing shirts in one's wardrobe to be reused and converted easily into adaptive closures. This restores independence for the individuals with hand dexterity challenges caused by stroke, Parkinson's, MS, arthritis, permanent nerve damage and post upper extremity surgeries. With any of these conditions a side effect is the inability to button shirts.

This invention is to overcome limitations in fine motor skills with a magnetic system. The invention is a no-sew solution that converts existing shirt-buttons in minutes to restore one's ability to get dressed; a crucial activity of daily living. The user may dress oneself without assistance of a tool or another person. This is a less expensive option than current clothing available with the magnets sewn into the lapels. This invention does not currently exist and is first-to-market. There are similar patents filed, with magnetic closures, but none with this proprietary design, material application, dimensions, overall system, functionality and manufacturing process. In addition, it serves a larger purpose in restoring independence to an under-served disabled population.

This invention is distinctly different from the prior art in its engineered design for attachment to both button and buttonhole, as well as the preferred amount of magnetic flux for optimal functionality. This invention provides a niche for a particular magnetic adapter button system to provide social good for an aging and disabled population as well as people recovering from upper extremity surgery.

SUMMARY OF THE INVENTION

In accordance with the above-noted desires of the industry, the present invention provides various aspects, including a novel and non-obvious magnetic button clothing closure system, a method of making it, and a method of using it. This includes a special button cover with a special magnetic closure system. This overcomes most of the aforementioned problems with the prior art because one can operate the clothing closure system of the present invention by merely urging the two sides of the clothing together and urging the magnet to pull the clothing so that one can dress oneself and easily undress.

The components of the invention have one main function, to convert buttons into magnetic closures to help people with dexterity limitations get dressed. The magnetic button adapter system is comprised of two components and a sub assembly.

A first aspect of the present invention includes a female component designed to look like a fake button. This is positioned where a garment's original button would normally be located and serves as a mating piece to secure the second part into place. The parts connect through the buttonhole with interlocking female and male components.

Another aspect to the fake button is the center cavity. The special design in an hourglass shape prevents improper user installation.

Another aspect to the fake button feature is that the flexible material used allows for the semi-permanence to a mating part. It can be taken on and off to transfer to other garments.

Another aspect of the fake button is that it can be manufactured with one or two different colors on top and bottom adding a reversible feature to give the user two color options. When designed in this aspect, the center cavity is configured modified for installing in either direction.

Another aspect of the invention has other features including the fake button has the ability to be constructed as a two-part subassembly. It is designed so the outward facing front is interchangeable. This aspect of the component expands colors, materials, and ornamental options.

Another aspect of the invention has a feature including the second part, the fake button male mate that connects to the fake button. The component has a small base and a head that extends upwards. This component is made from ferritic stainless steel or can be made as a subassembly of plastic and iron. This feature attaches to the mating fake button by inserting the tip behind the original buttonhole into the female fake button component cavity to securely snap into place.

Another aspect of the fake button male mate invention is that it is specially engineered to attract a third sub assembly to easily activate the system. This aspect is constructed with ferritic material of specific dimensions to achieve desired pull force to makes it easy to close and open a garment.

Another aspect of the fake button male mate is that the head of the part is specially designed with a rounded feature for semi-permanence to be taken on and off with ease.

A third feature is the button cap over-mold sub assembly. The cap attaches over an existing button and has a proprietary undercut design to wrap around the underside of button and snap securely into place. The undercut design feature create a semi-permanent attachment to the existing button and the material selection to allow the invention to be put on and removed, yet durable enough to withstand washing and drying.

A critical aspect of the adaptive system is the magnetic component. A neodymium (NdFeB) N45 ring or disk magnet resides in the button cap to provide a specifically engineered dimension for maximizing magnetic flux and attracting the opposing lapel to create a secure closure.

This technique of button and buttonhole attachment may therefore be extended to include not only use by people with hand dexterity limitations, but to also change aesthetics as a fashion accessory.

This system of adapting a button and buttonhole can be applied beyond shirts to include shoes and accessories.

The invention is particularly useful for applications to improve independent dressing, restoring confidence, and expanding wardrobe options.

Once the button adapter system is attached to the garment, the components are machine washable and dryable and can be used repeatedly. The proprietary semi-permanent design allows button adapter system to be transferred to another garment. This system does require fine motor skills to apply the magnetic button system.

Although the invention will be described by way of examples hereinbelow for specific aspects having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different aspects and its details are capable of modifications of various aspects which will be obvious to those of ordinary skill in the art all without departing from the spirit of the present invention. Accordingly, the rest of the description will be regarded as illustrative rather than restrictive.

BRIEF DESCRIPTION OF THE DRAWINGS

For a further understanding of the nature and advantages of the expected scope and various aspects of the present invention, reference shall be made to the following detailed description, and when taken in conjunction with the accompanying drawings, in which like parts are given the same reference numerals, and wherein the present invention will be described in more detail with reference to the particular details and distinctly different claims in the attached drawings and preferred aspects. The invention, however, both as to organization and method of operation, together with parts, features, and advantages will be best understood by reading the accompanying drawings and descriptions.

DETAILED DESCRIPTION OF THE INVENTION

Figure 1:
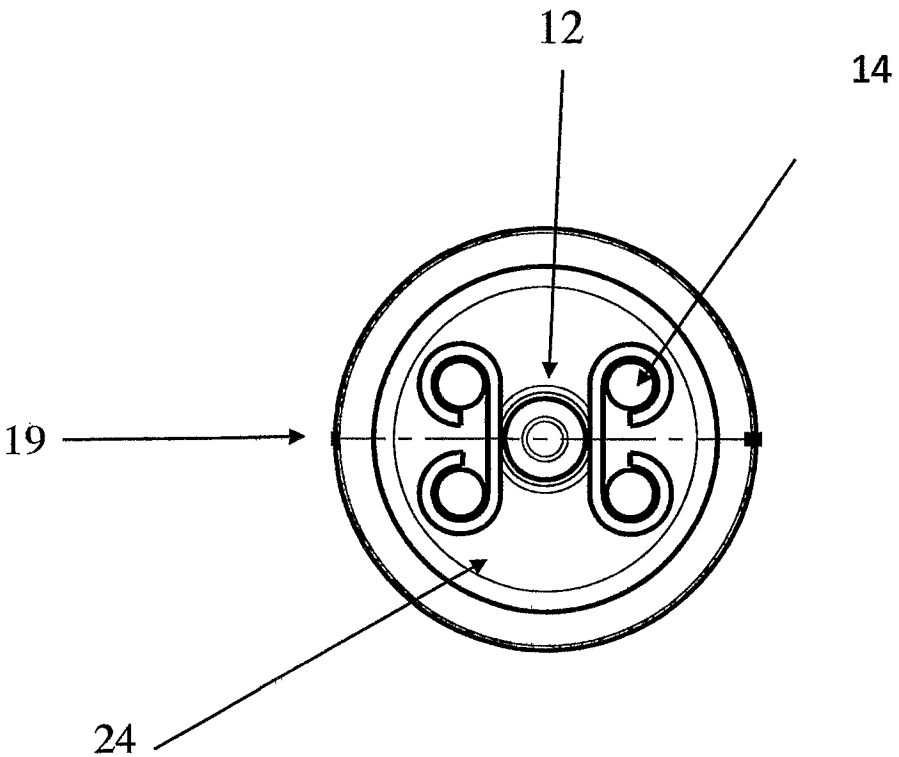
FIG. 1 is a top view depicting an aspect of the "fake button" that is designed to attach to a mating part through shirt buttonhole and herein referred to as fake button.
Figure 5:
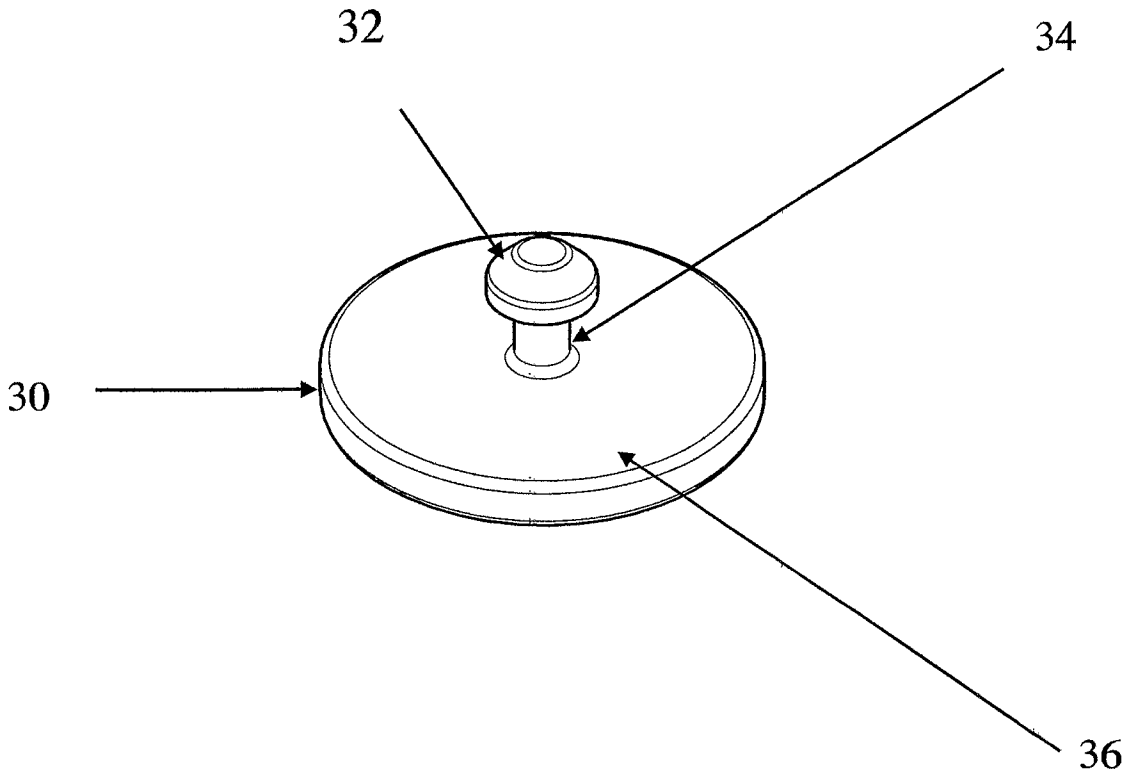
FIG. 5 is an angle view of stainless steel ferritic mechanism herein called fake button male mate component that locks to mating piece of FIG. 1 fake button part 12 and is essential for activating pull force to FIG. 7 button cap adapter.

Referring now to the drawings in detail, FIG. 1 shows a top view that depicts an aspect of buttonhole attachment to second part FIG. 5 herein referred to as fake button. The first component of the button adapter is the fake button that is positioned on a garment to replicate where the original button would traditionally be located. The material is preferably a composite of recycled pet plastic and or other materials not limited to pet. The flexible material allows for semi-permanence to a mating part. It can be taken on and off to transfer to other garments. Designed to look like a button with a raised company logo 14 that is specially designed to look like a button with fake holes that replicate where button can be stitched onto garment. This female part has a center cavity hole 12 for adjoining with the mating male part FIG. 5 fake button male mate 32. The diameter 19 prevents fake button from sliding through buttonhole. The front face 24 is specially designed to be interchangeable to expand color options.

Figure 2:
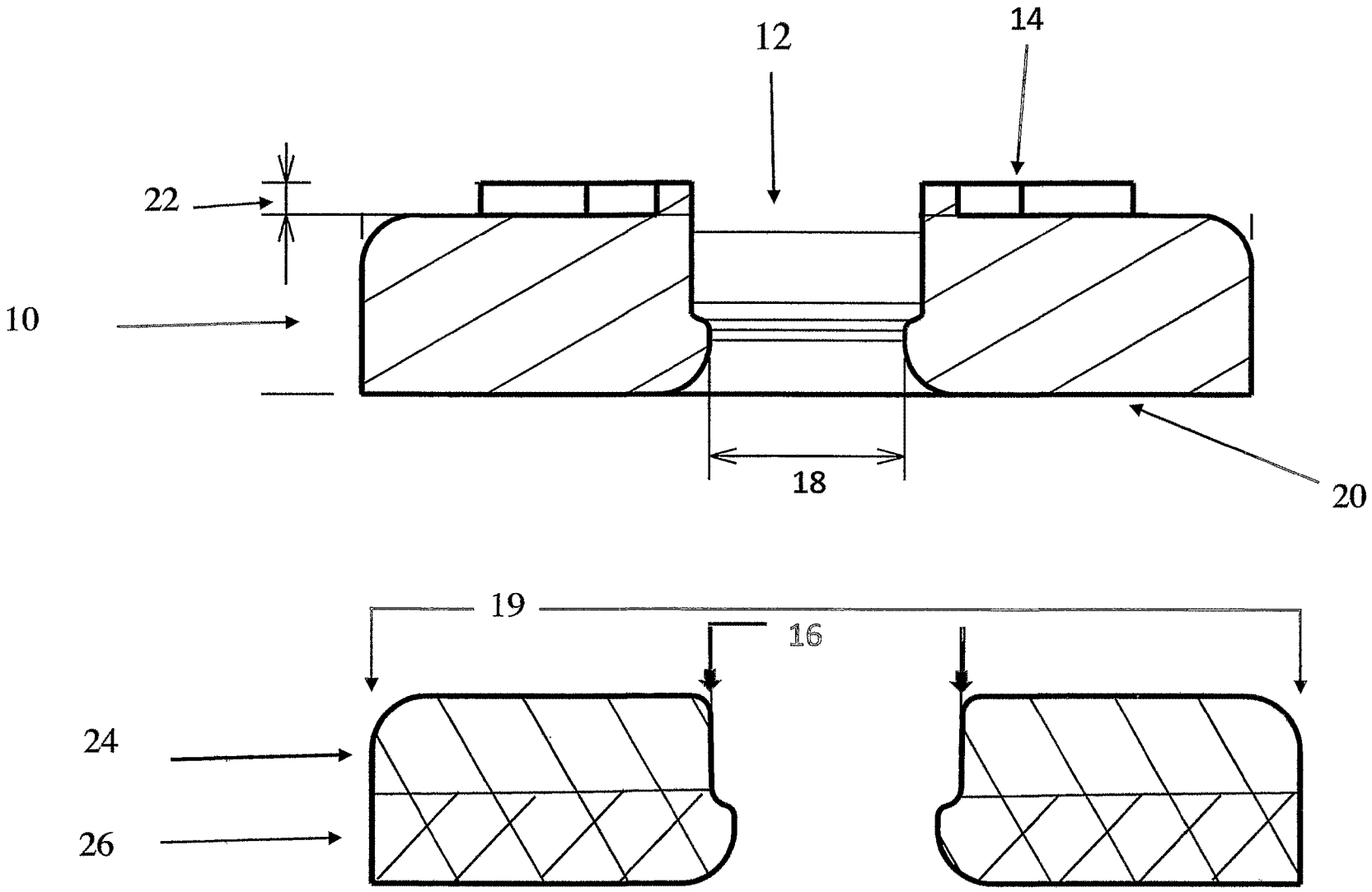
FIG. 2 is a side view fake button exhibits proprietary design configurations and 2-color or inner changeable front face options.

FIG. 2 is a side view of the fake button which has a raised logo 14 to allow installer to feel texture 22 to make it easy for the installer know right direction. This is an optional feature and may or may not be included depending on the intended production color feature. The fake button can be manufactured as one single color 10 or it can be produced in two different colors 24 and 26 to expand color choices with one part. This expands color choice from one to two for user by simply flipping part over. The special designed 12 center cavity prevents installing incorrectly with juxtaposed diameter 16 and smaller diameter 18. This design feature ensures the front facing feature 14 showing correctly and prevents installing backwards. However, produced in two-colorway feature, the inner diameter 18 will be centered in an hourglass shape to be a pokeyoke for reversibility aspect. The part can be special designed for two-color manufacturing option with top 24 and reversible bottom 26 to expand color options. This increases color choices in a cost efficient production process while increasing product appeal. The diameter of component 19 prevents fake button from sliding through buttonhole. Diameters 16 and 18 are engineered to receive the FIG. 5 metal head 32 and be inserted in a specific way for proper installation. The smooth texture bottom surface 20 helps to install properly and maximize surface area contact to hold in place securely.

Figure 3:
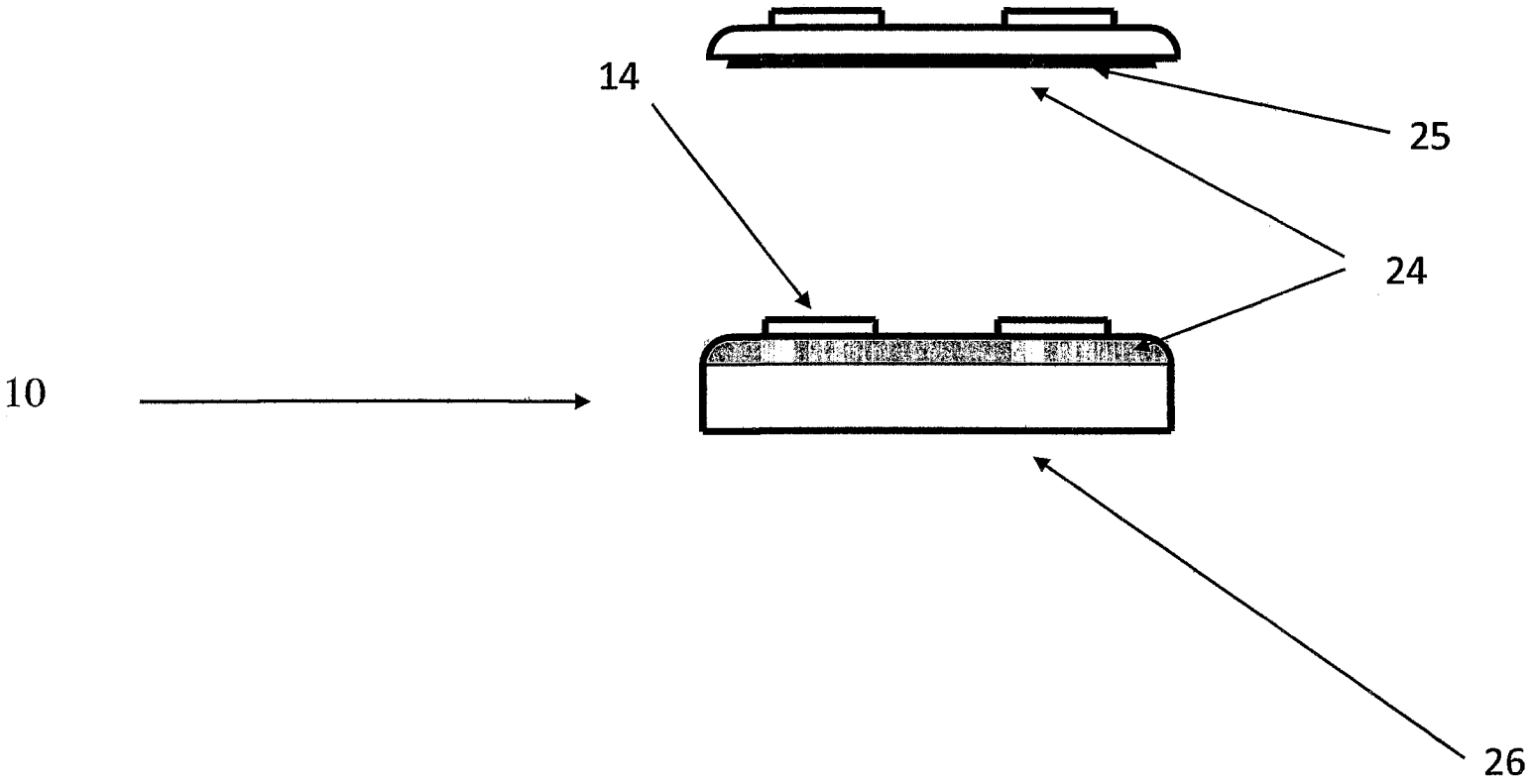
FIG. 3 is a side view fake button illustrating a design feature for 2-color assortment and interchangeable face part.

FIG. 3 is a side view which illustrates two design features. This can be manufactured as one single color 10 or in 2 colors (top 24 and bottom 26) to provide two-color options for users. Alternatively, the part can be manufactured as two parts as such that 24 is an interchangeable face that detaches to bottom part 26 and is available in multiple colors. This part 24 will be an entirely separate component to further expand color, material, texture and logo 14 options and snaps into bottom part 26 by bottom angled clip feature 25.

Figure 4:
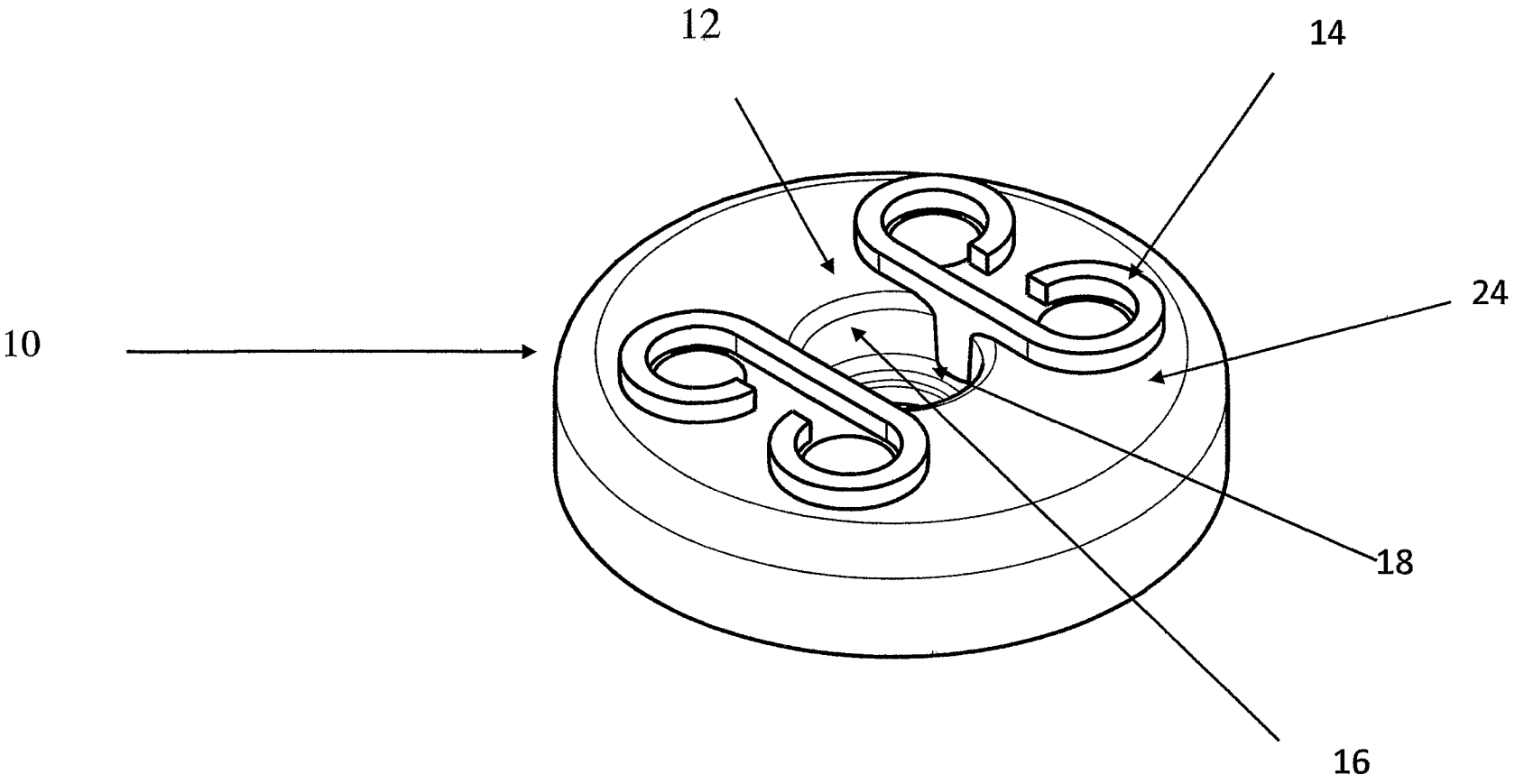
FIG. 4 is the angle view of fake button identifies proprietary inner female chamber hourglass design to prevent installation error.

FIG. 4 is an angle view of the fake button. Inner cavity 12 illustrates different diameters of elements 16 and 18 to guide and to prevent improper installation to mating piece FIG. 5 head 32. This illustration clarifies the interchangeable front face 24 element and raised fake button 14 feature. Element 10 indicates the single color option.

Figure 6:
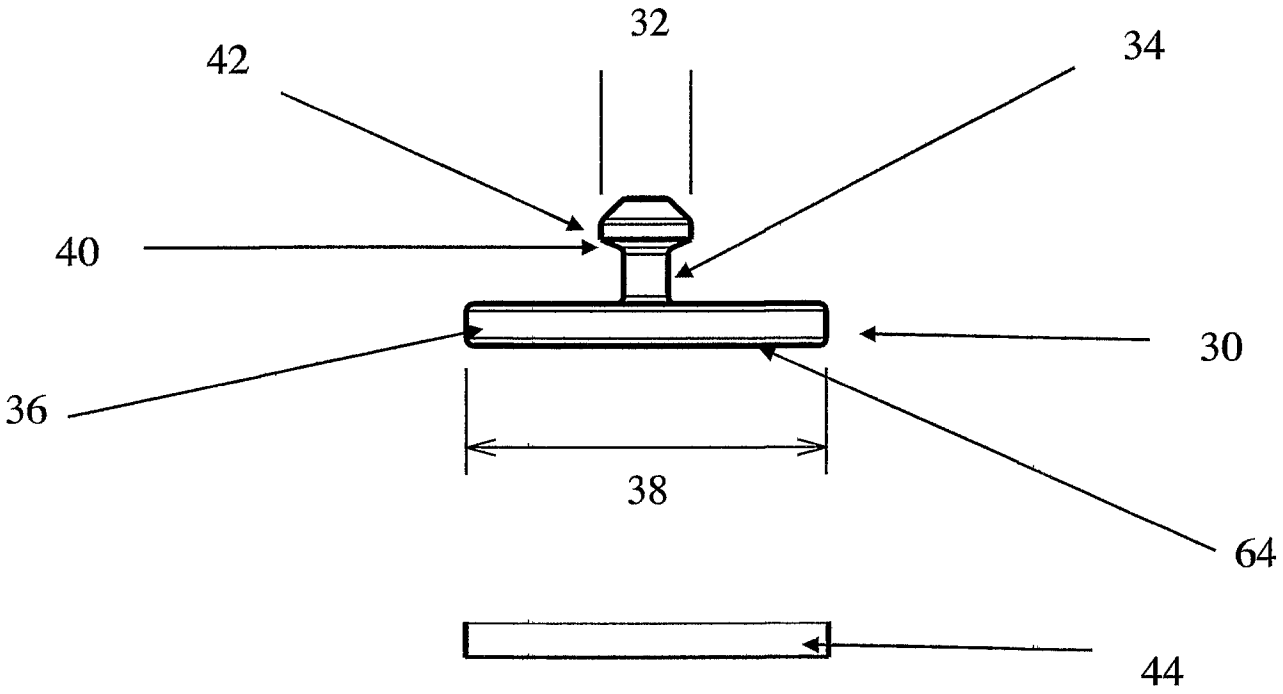
FIG. 6 is a side view fake button male mate component.

FIG. 5 is a fake button male mate component made of one or more materials; including, but not limited to, stainless steel ferritic metal or a plastic element 36 which then encases FIG. 6 element 44 which could be a magnetic disk or stainless steel ferritic disk. Material selection is intended to be corrosion resistant. This attaches to FIG. 1 fake button by inserting tip 32 and post 34 through buttonhole in mating part female center cavity hole FIG. 2 element 12. The post 34 height allows one way installation and secures tightly to mating fake button to sandwich shirt between the two components. The head of part is a specific diameter, element 32 to fit into FIG. 2 center cavity hole 12 with a +/−0.01 variability. Thickness of component 30 is calculated to maximize pull force to opposing part FIG. 9 button cap adapter where magnet FIG. 12 resides embedded in FIG. 9 component.

FIG. 6 is a side view of the fake button male mate head 42 with rounded head to lead easily into FIG. 2 center cavity hole element 12 and rounded under side 40 to easily push in and pull out of FIG. 2 center cavity hole element 12 yet durable enough to withstand laundry. The special design allows for transferability to other garments. Element 32 indicates the specific engineered diameter to fit into FIG. 2 cavity of element 12. Element 34 stem is a specific height to ensure part locks securely to mating piece FIG. 2 and latches securely to buttonhole. The diameter of element 38 is such that it will not pull through buttonhole. The component 36 can be made out of a singular material or optional metal or plastic that encapsulates a sub component 44 which can be made out of a magnet or stainless steel ferritic part. Element 64 indicates the space where a second, optional design part 44 will reside. The thickness 30 and diameter 38 are engineered to maximize pull force base to FIG. 9 magnet in cap and optimize functionality.

Figure 7:
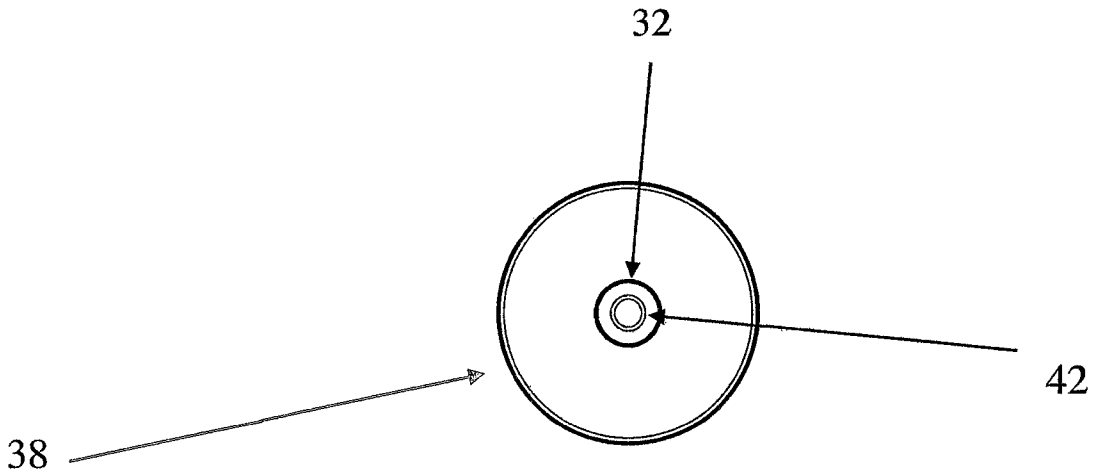
FIG. 7 is a top view fake button male mate component.

FIG. 7: top side view of male mate illustrates rounded head has varying dimensions elements 32 and 42 to make entry into female part FIG. 1 fake button center cavity 12 semi-permanent. The overall diameter 38 is specially engineered to maximize pull force by maximizing surface area and will not pull through buttonhole during use.

Figure 8:
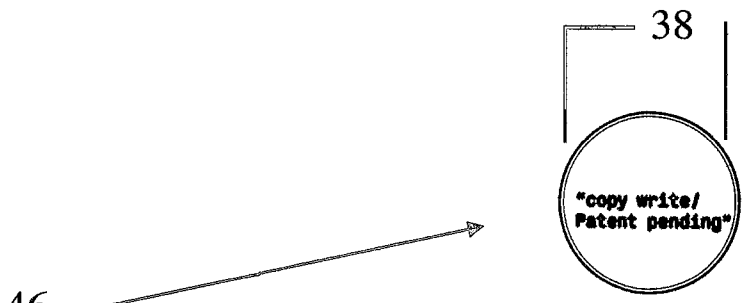
FIG. 8 is a under side fake button male mate component.

FIG. 8 is the bottom side of fake button male mate or male mate part placement engraved or embossed logo and/or patent protection element 46. The overall diameter element 38 is specially engineered to maximize pull force by maximizing surface area and will not pull through buttonhole during use.

Figure 9:
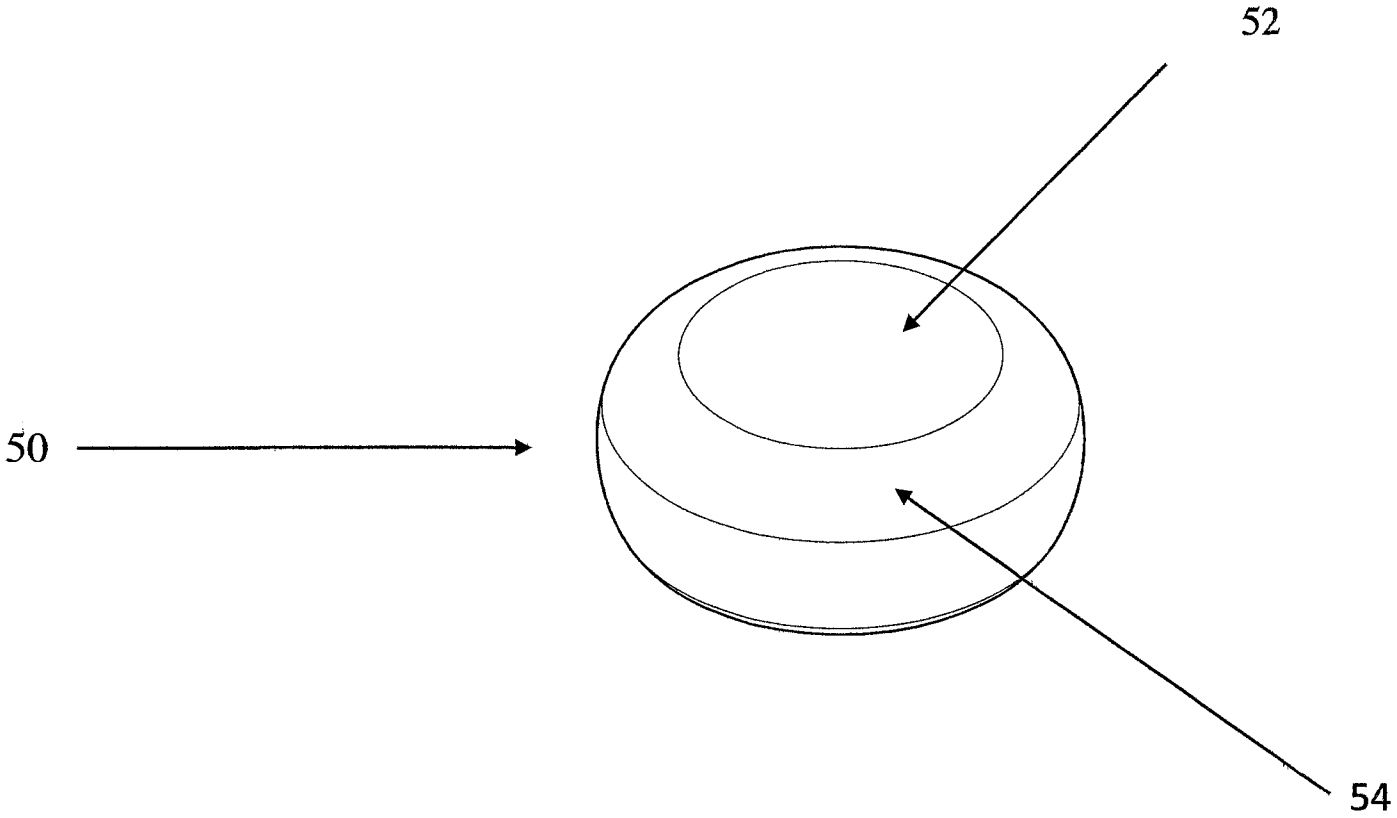
FIG. 9 is an angle view of sub assembly component herein referred to as the "button cap adapter". A magnet resides inside to attract FIG. 6 fake button male mate component, being manufactured with or without magnet.
Figure 12:
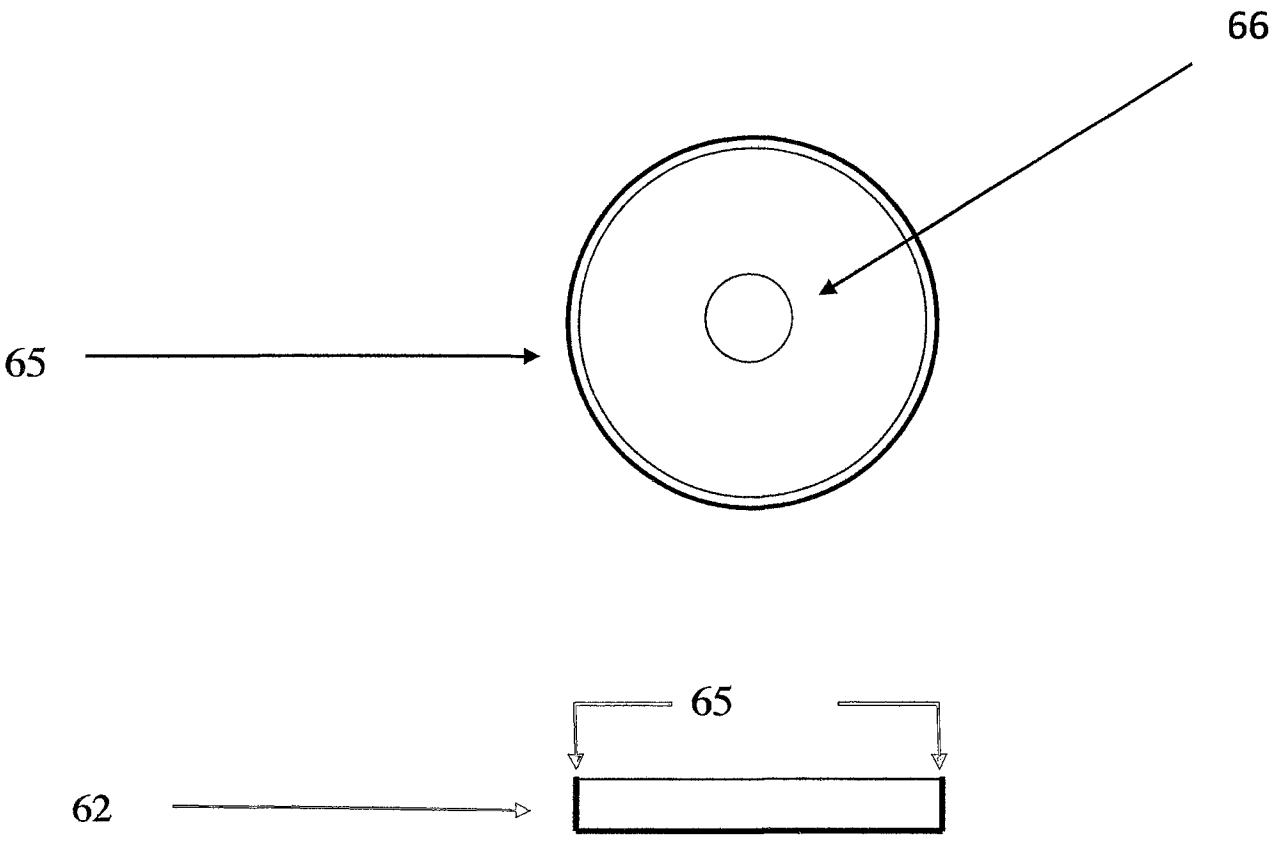
FIG. 12 is the neodymium magnet in either a ring 64 or disk. Especially engineered to maximize magnetic pull force with thickness 62 to attract to FIG. 8 fake button male mate 46. Resides in FIG. 13 sub assembly button cap chamber 52. Inner hole for manufacturability.

FIG. 9 is an angle view of sub assembly button cap adapter designed to attach to buttons and may (or may not) have FIG. 12 magnet reside inside. Made out of soft plastic shore a durometer element 50 indicates specific shore a plastic properties for memory essential for function. Magnet resides in inner cavity element 52 that is below illustrated surface that attracts through plastic to FIG. 6 ferritic fake button male mate element 44. Element 54 indicates the component can be produced in different colors options to be used to change the aesthetics of garments as an embellishment (without housing magnet). Can be manufactured with (or without) an injection molded magnet FIG. 12.

Figure 10:
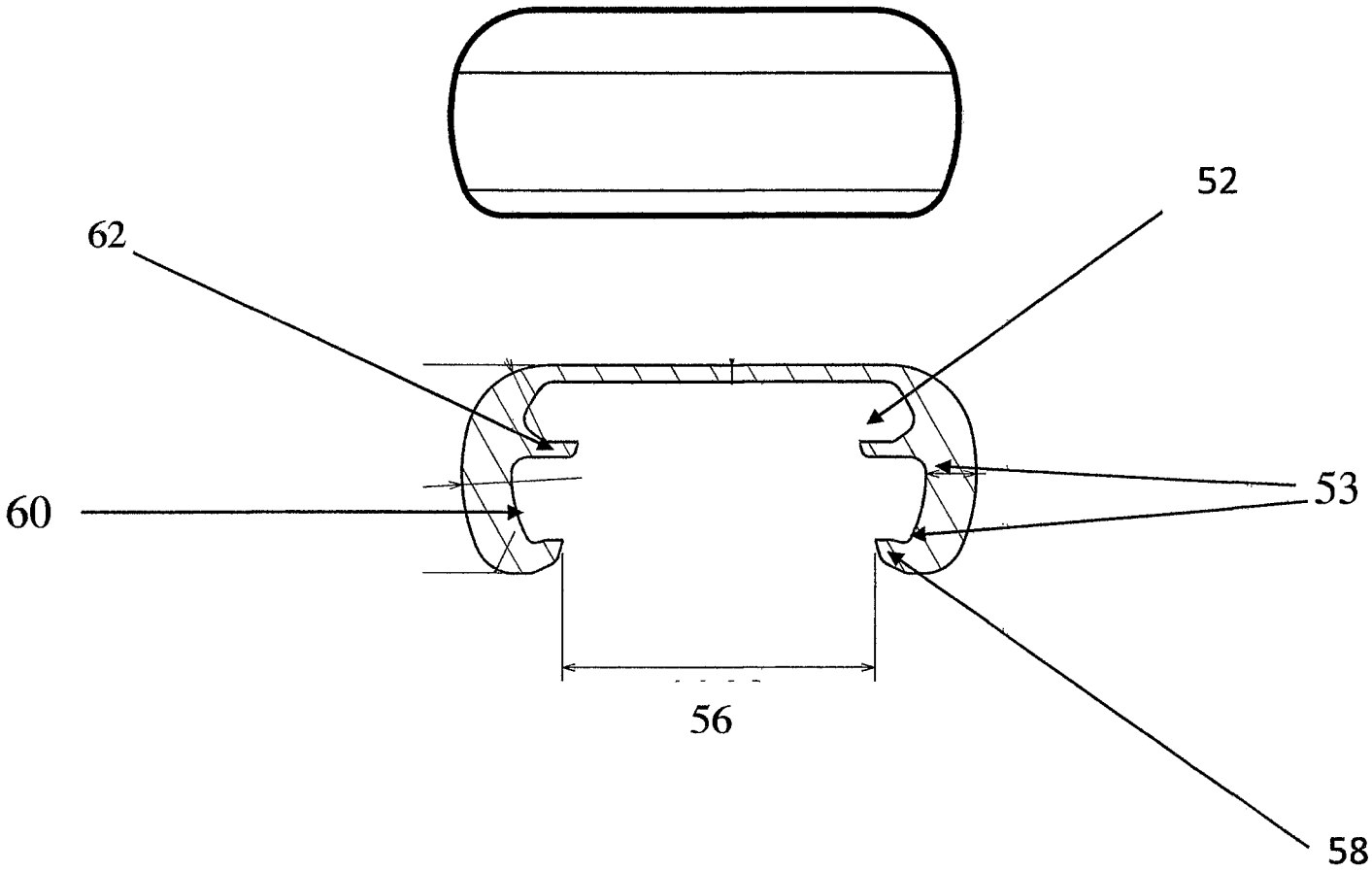
FIG. 10 side view of sub assembly button cap adapter to illustrate proprietary attachment locking system, engineered angles for maximum durability and an inner shelf to hold magnet.

FIG. 10 shows a side view button cap adapter with specially engineered diameter 56 to accommodate and snap onto a range of existing buttons that sit inside inner chamber element 60. The undercut 58 creates a proprietary design with engineered angles elements 53 for durability to past original button sides and secure to underside of button. Plastic memory properties, specially selected for superior functionality to make component semi-permanent, transferable to other buttons and machine and dryer tolerant. The inner shelf 62 holds magnet FIG. 12 in place inside chamber element 52. Specially designed angles engineered 53 for maximum durability and resistant to taking on and off.

Figure 11:
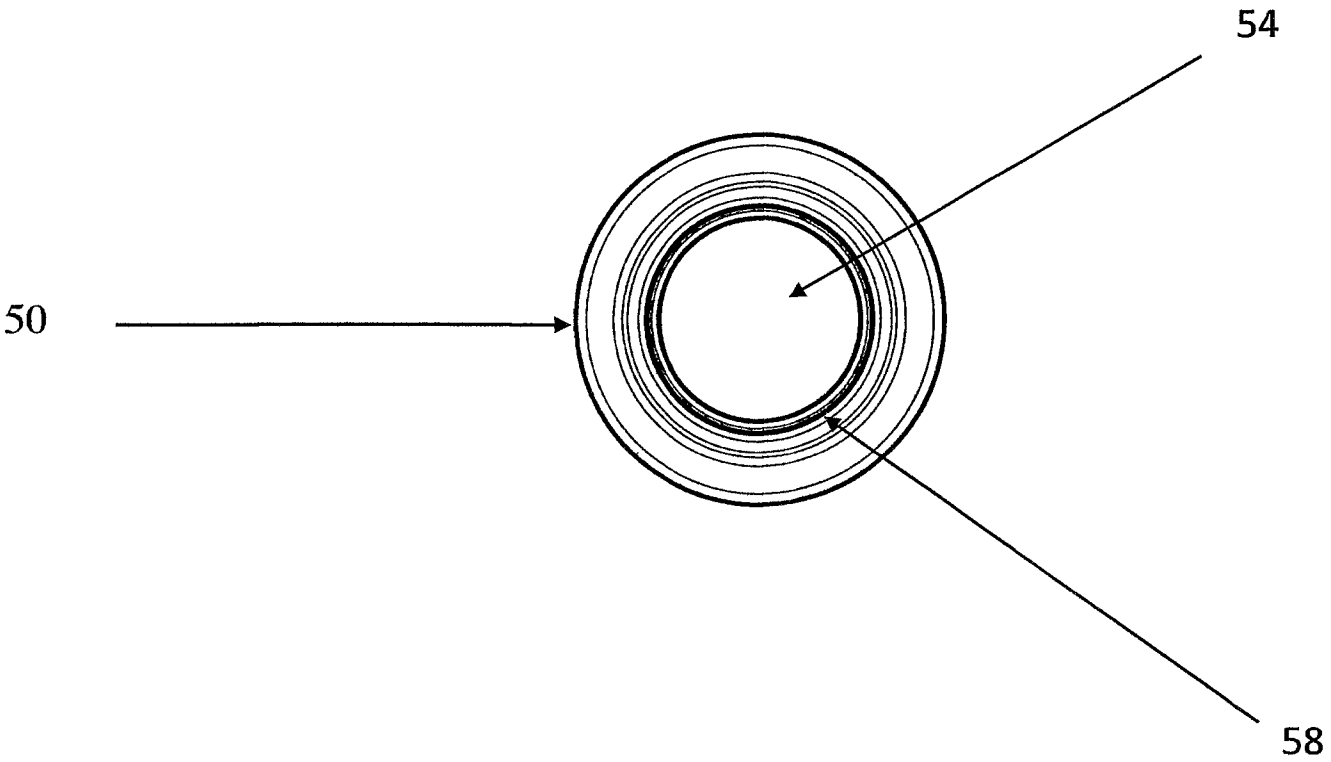
FIG. 11 underside view button cap adapter illustrates proprietary undercut with locking feature to attach to button.

FIG. 11 shows an underside view which illustrates the central housing 54 to insert button with the proprietary undercut 58 construction that secures to the underside of button and fit securely around the backside of button to make it machine and dryer tolerant. The exact diameter 50 dimension is engineered to accommodate traditional size buttons. Can house plastic ring size adapter FIG. 13.

FIG. 12 is the magnet top and side view. Material is selected from any strong magnetic material with material properties from 1000 Gauss up to 50,000 Gauss or 50 Tesla strengths, but is preferably made of rare earth magnets, such as neodymium (ndfeb) n45, in the shape of a ring or disk with a br=1.35 Tesla, or 13,500 Gauss. Specially designed to maximize magnetic flux with the thickness of part 62 and outer diameter 65 are engineered to specific dimensions. Surface area maximization and alternative concentric construction with pinch point design to enhance pull force. The inner diameter element 66 is such to enable injection mold manufacturing but is not limited to ring configuration and may use disk magnets.

Figure 13:
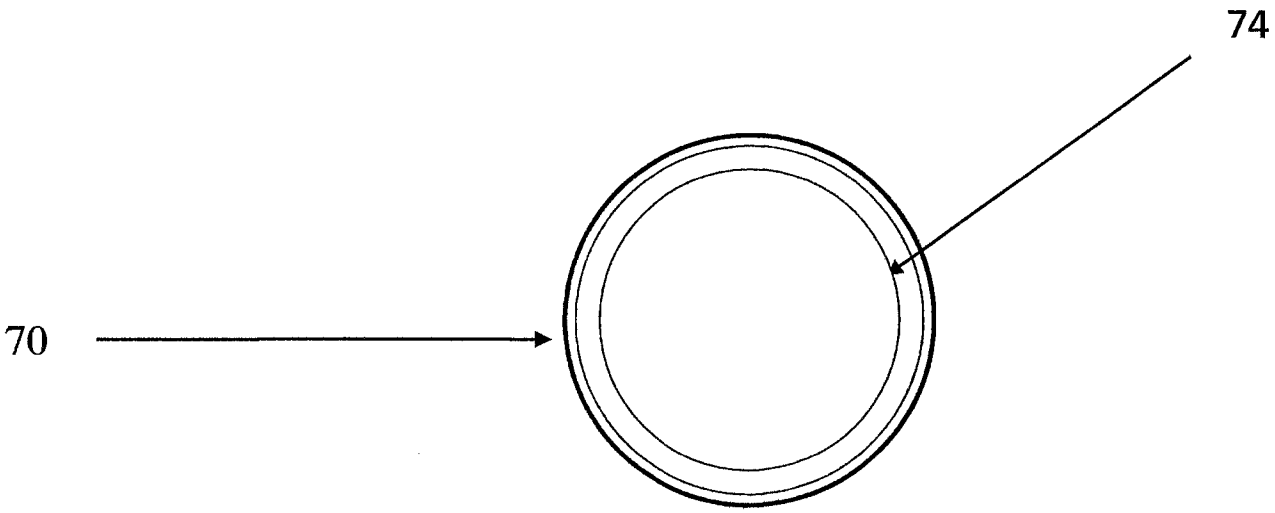
FIG. 13 is the plastic size adapter ring designed to be inserted into FIG. 10 button cap inner chamber 60 to retro fit button cap to accommodate smaller sized buttons.

FIG. 13 is an add-on part plastic ring size adapter part, specially designed with outer diameter 70 to fit inside sub assembly button cap FIG. 10 inner chamber element 60. Inner diameter element 74 specifically sized to secure smaller sized buttons. The material is plastic or silicone to provide necessary flexibility. The component is intended to insert part into FIG. 10 chamber 60 to fill space to accommodate smaller buttons to fit securely into place.

Figure 14:
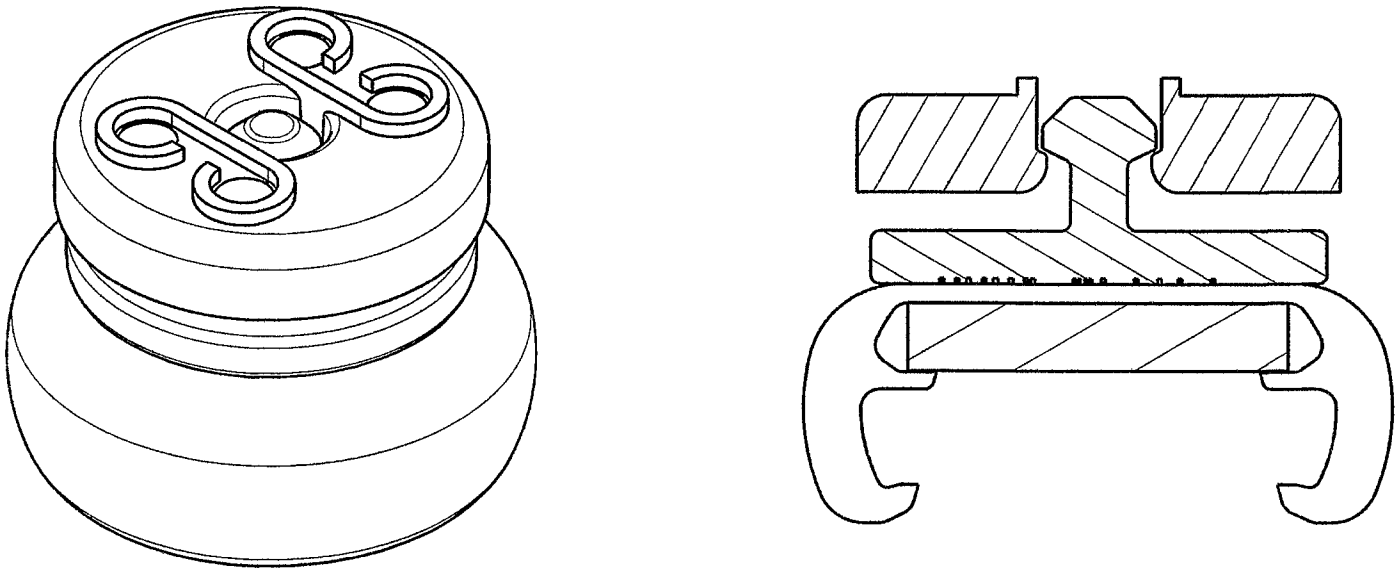
FIG. 14 is an assembly overview.

FIG. 14 shows a complete illustration of a magnetic button cover made in accordance with the present invention.

The disclosed aspects are illustrative, not restrictive. While specific configurations of the button adaptive magnetic system this product is not limited to the design mentioned in this patent, if improvements or new technology impacts the way of manufacturing. This System is versatile in the two sub assemblies, one component and one part that make up this system. The "fake button" could be used to change the aesthetic of garments as an embellishment. The adaptive cap could be used in different colors and patterns to create a different way to express oneself in button down shirts. As a system though this provides lifestyle improvement by allowing individuals to wear their existing button down wardrobe and would not be expected to change or buy a new wardrobe. The cost savings of this system to large institutions would be tremendous as the care givers in the facility only have to attach the system once, then they have time to spend on addressing the more serious patients. Also, this product reduces the stress on care givers either at home or in an institution. This system provides emotional restoration to the clients, caregivers and family by restoring dignity and empowering individual choices.

Referring next to the method of manufacturing, the magnetic button adapter system comprises of the following processes:

A. Fake button: injection mold intended to use, but not limited to, recycled pet plastic and/or resin compounds. Properties include shore a durometer of from 50 to 200, and preferably about 95 for optimizing fit, and allowing for +/−0.01 variance. This material selection allows for component to be taken on and off. The specs to create this "fake button" are a certain diameter and a certain height (with a raised logo (b2b) designed to have different colors. This female "fake button" has an engineered specification with the component b, the fake button male mate. Specifically designed center cavity with inner hourglass smaller diameter to prevent installing backwards. Specific diameter allows fake button male mate component head to detach to remove assembly from the buttonhole. The top part is designed such that is can be manufactured in two different colors (top and bottom). This gives a reversible feature to expand color choices to two options in one part. An alternative manufacturing option is that the component top is removable. Additional "front facing" parts to increase color assortment, can easily snap in and out of "fake button" face.

B. Fake button male mate is a screw machined part or injection molded sub assembly intended material, but not limited to, ferritic stainless steel or two materials; plastic resin overmold stainless steel or disk magnet. The properties are a certain diameter and base height to maximize surface area for the intended magnetic pull force. The male post and rounded head are of specific dimensions to mate with "fake button" female part, prevent installation error and be removed easily. This male part attaches by inserting head through the buttonhole and into female "fake button" cavity. This part will also have a stamped logo on the underside of the base. This part is resistant to corrosion and has high iron content or disk magnet button cap adapter: injection molded compression or over-molded magnet (part 4) to attract ferritic mating fake button male mate component. Intended to use, but not limited to recycled plastic, silicon and/or other resins. Properties are shore a durometer of. The material is such that the component has memory to attach to original button and wrap around underside securely. It is soft enough to be removed and attached to other buttons. It is durable enough to withstand laundry. The specs to create this "button cap adapter" are a certain diameter and a height. Designed to attach to standard button sizes. The "button cap adapter" attaches directly to the button by capturing the underside of the bottom with the proprietary undercut. The undercut has angles engineered to withstand taking "button cap" on and off and be durable enough to withstand laundry. The specific dimension of height and thickness of "button cap" create minimal gap in shirt closing. The magnet resides in a proprietary inner shelf with specially engineered angles to hold in place. The diameter maximizes surface area to achieve desired pull force to attract fake button male mate component. The manufacturing is designed to handle magnet part safely with specially created molds for over mold injection process. The part can also be manufactured without magnet. The intend use is for cosmetic purposes to change shirt button colors and embellish garment buttons.

C. Magnet: element of the earth, specially designed to maximize magnetic flux for system functionality. Manufactured to predetermined sizes with engineered surface area and thickness. This creates a proprietary element of system. Magnet will reside in "button cap" in the proprietary shelf. The proprietary magnets are manufactured without magnetization for ease of processing and safety.

D. Each adapter system comprises of one sub assembly that secures over an existing button and two mating components that secure through a buttonhole. The product contains a unique construction that is easy to install. The configuration of materials maximizes magnet pull force for enhanced functionality. The semi-permanent construction of the invention enables easy installation, removal, and transferring to other shirts. The adapters have an aesthetically pleasing look with rounded edges and slim appearing profile to minimize bulk. The magnets within the adapters are designed to withstand regular machine washing and drying and will be corrosion resistant.

In summary, numerous benefits have been described which result from employing any or all of the concepts and the features of the various specific aspects of the present invention, or those that are within the scope of the invention.

The foregoing description of a preferred aspect of the invention has been presented for purposes of illustration and description. It is not intended to be exhaustive or to limit the invention to the precise form disclosed. Obvious modifications or variations are possible in light of the above teachings with regards to the specific aspects. The aspect was chosen and described in order to best illustrate the principles of the invention and its practical applications to thereby enable one of ordinary skill in the art to best utilize the invention in various aspects and with various modifications as are suited to the particular use contemplated. It is intended that the scope of the invention be defined by the claims which are appended hereto.

What is claimed is:

1. An interchangeable magnetic button adapter for converting buttons of button closure garments to magnetic closure garments, comprising:

a frontside buttonhole attachment component defining a hole therethrough and comprising:

a front face that is outward facing when the frontside buttonhole attachment component is installed on a frontside of a buttonhole, and a bottom surface that at least partially interfaces with a backside buttonhole attachment component and the frontside of the buttonhole when the frontside buttonhole attachment component is installed on the frontside of the buttonhole, wherein an inner wall of the hole has a first diameter and a second diameter, the first diameter being adjacent to the front face and the second diameter being adjacent to the bottom surface, wherein the first diameter is larger than the second diameter;

the backside buttonhole attachment component comprising:

a ferritic component comprising a top side and a bottom side, wherein the bottom side is configured to magnetically interface with a button adapter, and wherein the top side comprises:

a stem attached to a head, the head further comprising a tip opposite the stem, wherein at least a portion of the stem, the head, and the tip are configured to extend from a backside of the buttonhole through the buttonhole to the frontside of the buttonhole, wherein a diameter of the tip and a diameter of the stem are each substantially equal to the second diameter of the hole and a diameter of the head is substantially equal to the first diameter of the hole; and the button adapter having a top side and a bottom side that is configured to receive a button of the garment, the button adapter defining a magnet holding chamber adjacent to the top side and a button securing chamber adjacent to the bottom side, wherein the magnet holding chamber is configured to secure a magnet therein, wherein the button of the garment is configured to be secured in the button securing chamber via a substantially circumferential undercut of the bottom side of the button adapter, and wherein the top side of the button adapter is configured to magnetically interface with the bottom side of the ferritic component of the backside buttonhole attachment component when the button of the garment is secured in the button securing chamber of the button adapter.

2. The adapter of claim 1, wherein the head comprises a rounded underside, opposite the tip, where the head attaches to the stem.

3. The adapter of claim 2, wherein the first diameter transitions to the second diameter along a contour of the inner wall that substantially matches the rounded underside of the head.

4. The adapter of claim 1, wherein the frontside buttonhole attachment component has a diameter than is larger than a diameter of the buttonhole in the garment.

5. The adapter of claim 1, wherein the magnet holding chamber is separated from the button securing chamber via an inner shelf.

6. The adapter of claim 1, wherein the button of the garment is further configured to be secured in the button securing chamber via an angled wall of the button securing chamber.

7. The adapter of claim 1, wherein the front face of the frontside buttonhole attachment component is removably attached to the bottom surface of the frontside buttonhole attachment component to enable exchanging of the front face for a different front face.

8. The adapter of claim 1, wherein the bottom surface of the frontside buttonhole attachment component and the top side of the ferritic component of the backside buttonhole attachment component are configured to sandwich the garment therebetween.

9. The adapter of claim 1, wherein the button adapter comprises a polymeric material having a Shore A durometer of about 50 to about 500.

10. The adapter of claim 1, further comprising a filler component configured to be secured in the button securing chamber when a smaller button is secured therein.

11. The adapter of claim 1, wherein the ferritic component comprises one or more of: a ferritic stainless steel, a plastic resin overmold stainless steel, or a disk magnet.

12. The adapter of claim 1, wherein a diameter of the stem along its length is substantially uniform.

13. A method for converting buttons of button closure garments to magnetic closure garments, comprising:

positioning on a frontside of a buttonhole a frontside buttonhole attachment component defining a hole therethrough, wherein the frontside buttonhole attachment component comprises:

a front face that is outward facing when installed on the frontside of the buttonhole, and a bottom surface that at least partially interfaces with a backside buttonhole attachment component and the frontside of the buttonhole, wherein an inner wall of the hole has a first diameter and a second diameter, the first diameter being adjacent to the front face and the second diameter being adjacent to the bottom surface, wherein the first diameter is larger than the second diameter;

positioning on a backside of the buttonhole the backside buttonhole attachment component comprising:

a ferritic component comprising a top side and a bottom side, wherein the top side comprises a stem attached to a head, the head further comprising a tip opposite the stem;

inserting at least a portion of the stem, the head, and the tip from the backside of the buttonhole through the buttonhole to the frontside of the buttonhole, inserting the tip, the head, and at least part of the stem into the hole defined by the frontside buttonhole attachment component, wherein a diameter of the tip and a diameter of the stem are each substantially equal to the second diameter of the hole and a diameter of the head is substantially equal to the first diameter of the hole; and inserting a button of a garment into a button securing chamber of a button adapter, wherein the button adapter defines a magnet holding chamber adjacent to a top side and the button securing chamber adjacent to the bottom side, wherein the magnet holding chamber is configured to secure a magnet therein; and magnetically interfacing the top side of the button adapter, with the magnet in the magnet holding chamber, with the bottom side of the ferritic component of the backside buttonhole attachment component.

14. The method of claim 13, further comprising securing the button in the button adapter by a substantially circumferential undercut of the bottom side of the button adapter.

15. The method of claim 13, further comprising removing the front face of the frontside buttonhole attachment component to exchange the front face for a different front face.

16. The method of claim 13, further comprising securing a filler component in the button securing chamber when a smaller button is secured therein.

17. The method of claim 13, further comprising sandwiching the garment between the bottom surface of the frontside buttonhole attachment component and the top side of the ferritic component of the backside buttonhole attachment component.

18. The method of claim 13, wherein the head comprises a rounded underside, opposite the tip, where the head attaches to the stem.

19. The method of claim 18, wherein the first diameter transitions to the second diameter along a contour of the inner wall that substantially matches the rounded underside of the head.

20. The method of claim 13, wherein the magnet holding chamber is separated from the button securing chamber via an inner shelf.

* * * * *